US006619487B2

(12) United States Patent
Stuchlik, III

(10) Patent No.: US 6,619,487 B2
(45) Date of Patent: Sep. 16, 2003

(54) KNIFE HOLDER

(76) Inventor: Charles F. Stuchlik, III, 38175 S. Mountain Site Dr., Saddlebrooke, Tucson, AZ (US) 85739

( * ) Notice: Subject to any disclaimer, the term of this patent is extended or adjusted under 35 U.S.C. 154(b) by 39 days.

(21) Appl. No.: 09/938,659

(22) Filed: Aug. 27, 2001

(65) Prior Publication Data

US 2003/0038098 A1 Feb. 27, 2003

(51) Int. Cl.[7] ..... A47F 7/00
(52) U.S. Cl. ..... 211/70.7; 248/37.3
(58) Field of Search ..... 211/70.7, 70.6; 206/553; D7/637; 224/232; 248/37.3, 37.6; 30/151–152, 296.1, 299, 1, 124–125, 142–143, 164, 162, 138

(56) References Cited

U.S. PATENT DOCUMENTS

| | | | | | |
|---|---|---|---|---|---|
| 2,507,019 | A | * | 5/1950 | Johnson | 30/143 |
| 2,545,121 | A | * | 3/1951 | Szopa | 224/232 |
| 2,753,631 | A | * | 7/1956 | Culver | 248/37.6 |
| 3,524,570 | A | * | 8/1970 | Seguine | 224/232 |
| 4,423,552 | A | | 1/1984 | Bourgein et al. | |
| 4,509,651 | A | | 4/1985 | Prindle | |
| 4,511,040 | A | * | 4/1985 | Tolentino | 206/553 |
| 4,866,845 | A | * | 9/1989 | McEvily | 30/138 |
| 4,869,027 | A | * | 9/1989 | McEvily | 30/138 |
| 4,934,539 | A | * | 6/1990 | Lu | 211/70.7 |
| 4,964,554 | A | * | 10/1990 | Collins | 224/232 |
| 4,966,339 | A | * | 10/1990 | Lu | 211/70.7 |
| 5,067,239 | A | * | 11/1991 | Collins | 30/151 |
| 5,123,167 | A | * | 6/1992 | Kelley | 224/232 |
| D338,376 | S | | 8/1993 | Ulber | |
| 5,245,756 | A | * | 9/1993 | Howell et al. | 30/151 |
| 5,312,178 | A | | 5/1994 | King | |
| 5,379,520 | A | * | 1/1995 | Collins | 224/232 |
| 5,494,176 | A | | 2/1996 | Zallo | |
| 5,655,672 | A | | 8/1997 | Stuchlik, III | |
| 6,058,609 | A | * | 5/2000 | Yen et al. | 206/553 |
| 6,371,312 | B1 | * | 4/2002 | Tsuchida | 211/70.7 |
| 6,375,016 | B1 | * | 4/2002 | Stuchlik, III | 211/162 |

* cited by examiner

*Primary Examiner*—Daniel P. Stodola
*Assistant Examiner*—Jennifer E. Novosad
(74) *Attorney, Agent, or Firm*—Oliff & Berridge PLC

(57) ABSTRACT

A knife set includes a knife block having a plurality of knife-receiving slots, and a plurality of knives, corresponding in number to the plurality of knife-receiving slots. Each of the knives has a handle and a blade, with each blade having a sharpened edge. At least one of the knives, and a corresponding at least one of the knife-receiving slots, includes engaging structures that support the at least one knife in the corresponding at least one slot, preferably so that the sharpened edge is suspended within the slot out of contact with any portion of the knife block.

17 Claims, 3 Drawing Sheets

KNIFE HOLDER

BACKGROUND OF THE INVENTION

1. Field of Invention

The invention relates to knife holders, such as knife holding blocks that hold a plurality of knives, and in particular to knife holders that prevent the sharpened edges of the knife blades from becoming dull.

2. Description of Related Art

Knife holders for holding a plurality of knives, typically in the form of plastic or wooden blocks having a plurality of slots, are well known. The typical construction of these knife holders results in the knife blades being oriented vertically with the sharpened edge of each blade facing downward. In these typical knife holders, only the blades of the knives are inserted into the block. Therefore, the blades support the knives, and in particular, the sharpened edges of the blades contact the lower portion of the knife-holding slots in order to support the knives in the knife block. This causes the sharpened edges to become dull over the course of time.

SUMMARY OF THE INVENTION

It is one aspect of the invention to provide an arrangement in which a knife holder holds a plurality of knives without causing the sharpened edges of the knives from becoming dull. In accordance with this aspect of the invention, the knives are supported in a manner such that the sharpened edges of the knife blades do not contact the knife-holding slots in the knife holding block.

In accordance with a preferred embodiment, the invention relates to a knife set that includes a knife block having a plurality of knife-receiving slots, and a plurality of knives, corresponding in number to the plurality of knife-receiving slots. Each of the knives has a handle and a blade, with each blade having a sharpened edge. At least one of the knives, and a corresponding at least one of the knife-receiving slots, includes engaging structures that support the at least one knife in the corresponding at least one slot so that the sharpened edge is suspended within the slot out of contact with any portion of the knife block.

In a preferred embodiment, the handle of the knife includes an elongated protrusions on each side of the front portion of the handle that is located adjacent to the blade. The knife-receiving slots include enlarged (preferably tapered) openings into which the front portion of the knife handle is inserted. The openings include grooves that correspond to the elongated protrusions on the sides of the handle. This results in the handle being held by the knife block, with the blade suspended out of contact with the slot. Accordingly, the knife handle, rather than the blade, supports the knife in the block. Therefore, the blade does not become dull because the sharpened edge of the blade does not contact the slot.

The main object of the invention can be obtained numerous ways. For example, the above-described protrusions can be provided in the slot openings, and the grooves can be provided in the knife handle (or in the knife blade). In addition, the knife handle can support the knife in the block without providing protrusions/grooves in the front portion of the knife and in the slot opening. Furthermore, it is possible to provide a protrusion or groove on the knife blade, rather than on the handle, which then engages with a corresponding groove/protrusion in the slot. With this alternative, it is not necessary for the front portion of the knife handle to be inserted into the knife block.

BRIEF DESCRIPTION OF THE DRAWINGS

The invention will be described in conjunction with the following drawings in which like reference numeral designate like elements and wherein.

DETAILED DESCRIPTION OF PREFERRED EMBODIMENTS

The invention now will be described with reference to exemplary preferred embodiments. The invention can be used with various types of knife holders including, for example, (1) stationery knife holding blocks that are placed on countertops, as well as with (2) slidable knife holders in which the knife holding block is slidably mounted, for example, beneath cabinets, under countertops, etc. Such slidable knife holders are disclosed in U.S. Pat. No. 5,655,672 to the present inventor. The disclosure of U.S. Pat. No. 5,655,672 is incorporated herein by references in its entirety. In addition, and as will be described in more detailed below, the knife holder (i.e., the knife block) can include a locking mechanism that permits the knives to be locked within the knife holding block. Such locking mechanisms are disclosed in the present inventor's U.S. Pat. No. 6,375,016B1. The disclosure of U.S. Pat. No. 6,375,016B1 is incorporated herein by reference in its entirety.

Figure 1:
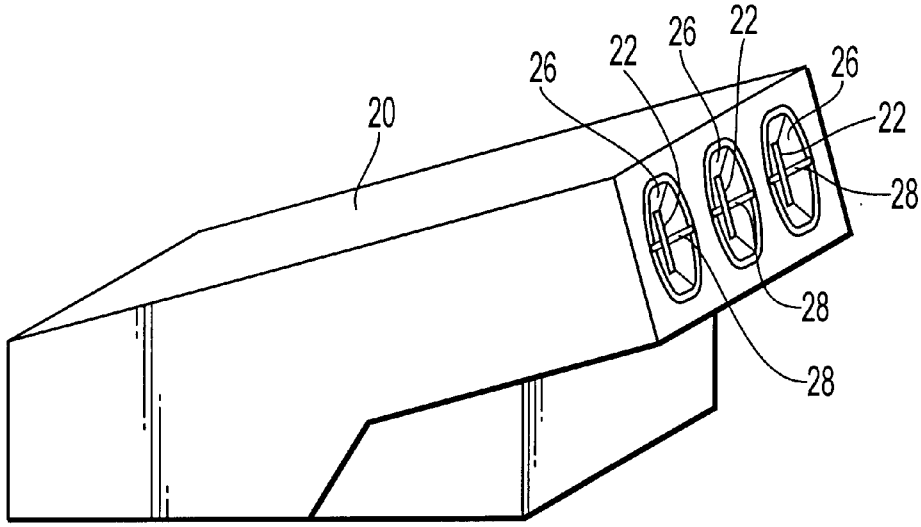
FIG. 1 is a perspective view of a knife block according to one embodiment of the invention.
Figure 2:
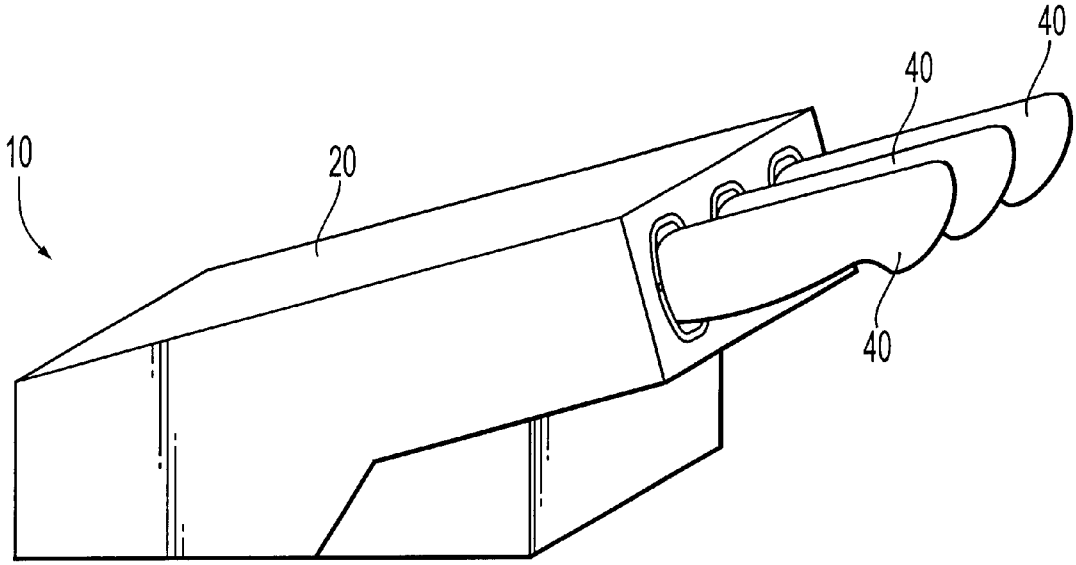
FIG. 2 is a perspective view of the FIG. 1 knife block with the knives inserted into the knife-receiving slots of the knife block.

As shown in FIG. 2, a knife set 10 includes a knife holding block 20 and a plurality of knives 40. FIG. 1 shows the knife holding block 20 without any knives inserted therein.

As shown in FIG. 2, the knife holding block 20 includes a plurality of knife-receiving slots 22. Each slot 22 receives a knife therein. Each of the slots includes an enlarged opening 26 into which a front portion of the corresponding knife 40 is inserted. In addition, each side of the enlarged openings 26 includes a groove 28. Each groove will receive an elongated protrusion, to be described below, provided on each side of the front portion of the handles of the knives 40.

Figure 3:
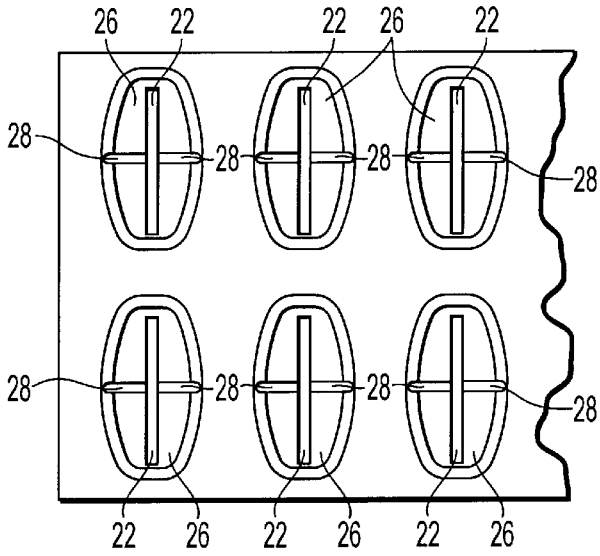
FIG. 3 is a plan view of the slots, including tapered, enlarged openings of the slots, in a knife block according to an embodiment of the invention.

FIG. 3 is a plan view of a knife block having six knife-receiving slots 22 therein. The structure of the slots is similar to what is provided in the knife block 20 of FIGS. 1 and 2. Each of the enlarged openings 26 is tapered such that the opening has its largest area at the surface of the block, and then tapers so as to have a smaller area adjacent to the blade-receiving slot 22. Each side of the tapered opening has a groove 28.

Figure 4:
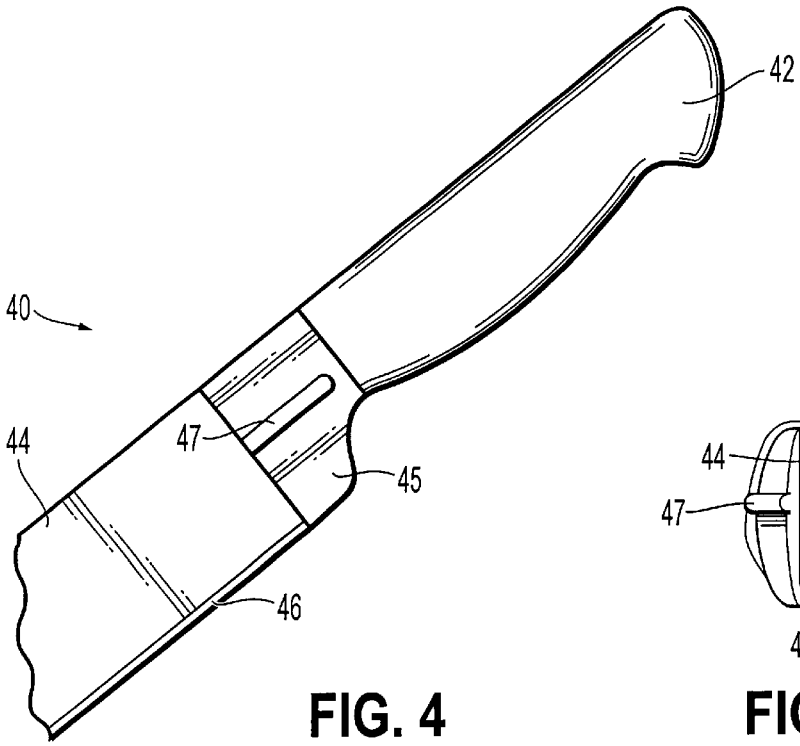
FIG. 4 is a side view of a knife that is usable with the FIG. 3 knife block.
Figure 5:
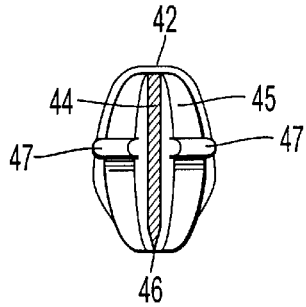
FIG. 5 is a front view of the FIG. 4 knife.

FIGS. 4 and 5 are side and front views, respectively, of a knife that is usable with the knife block of FIGS. 1–3. The knife 40 includes a handle 42 and a blade 44. The blade 44 includes a sharpened edge 46. The front portion 45 of the handle 42 is insertable into the enlarged opening 26 of the corresponding slot 22 in the knife block 20. Like the enlarged openings 26, the front portion 45 of the handle 42 is tapered so as to mate with the enlarged opening 26. Thus, and as shown in FIG. 5, the thickness of the front portion 45 increases as one moves from the blade 44 toward the gripping portion of the handle 42. In addition, each side of the front portion 45 of the handle 42 includes an elongated protrusion 47. Each elongated protrusion mates with a corresponding groove 28 provided in the enlarged opening 26 of the knife-receiving slot 22.

Accordingly, when the knife is completely inserted into the knife slot 22, the tapered, front portion 45 of the knife will be inserted into the enlarged opening 26. At this time, the elongated protrusions 47 will engage with the grooves 28. The knife will be supported by the engagement between the protrusions 47 and the grooves 48. Thus, the knife will be supported in the knife block 20 by the handle 42, rather than by the blade 44. By appropriately dimensioning the slot, the sharpened edge 46 of the blade will be suspended within the slot so that it does not contact any portion of the slot when the protrusions 47 and grooves 28 are engaged with each other.

Figure 7A:
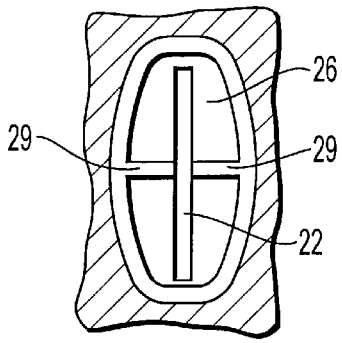
FIGS. 7A and 7B are front views of a modified knife-receiving slot and modified knife, respectively, in which elongated protrusions are provided in the enlarged opening of the knife slot, and grooves are provided on sides of the front portion of the knife handle.
Figure 7B:
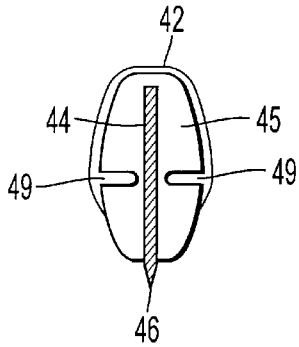

It is, of course, possible to provide the protrusions in the enlarged opening 26 of the knife-holding slots, and to provide corresponding grooves in the front portion 45 of the knives 40. Such an arrangement is shown in FIGS. 7A and 7B. In particular, FIG. 7A shows the elongated protrusions 29 in the enlarged opening 26 of the knife-receiving slot 22. FIG. 7B shows a knife having grooves 49 provided in each side of the front portion 45 of the handle 42.

Figure 6:
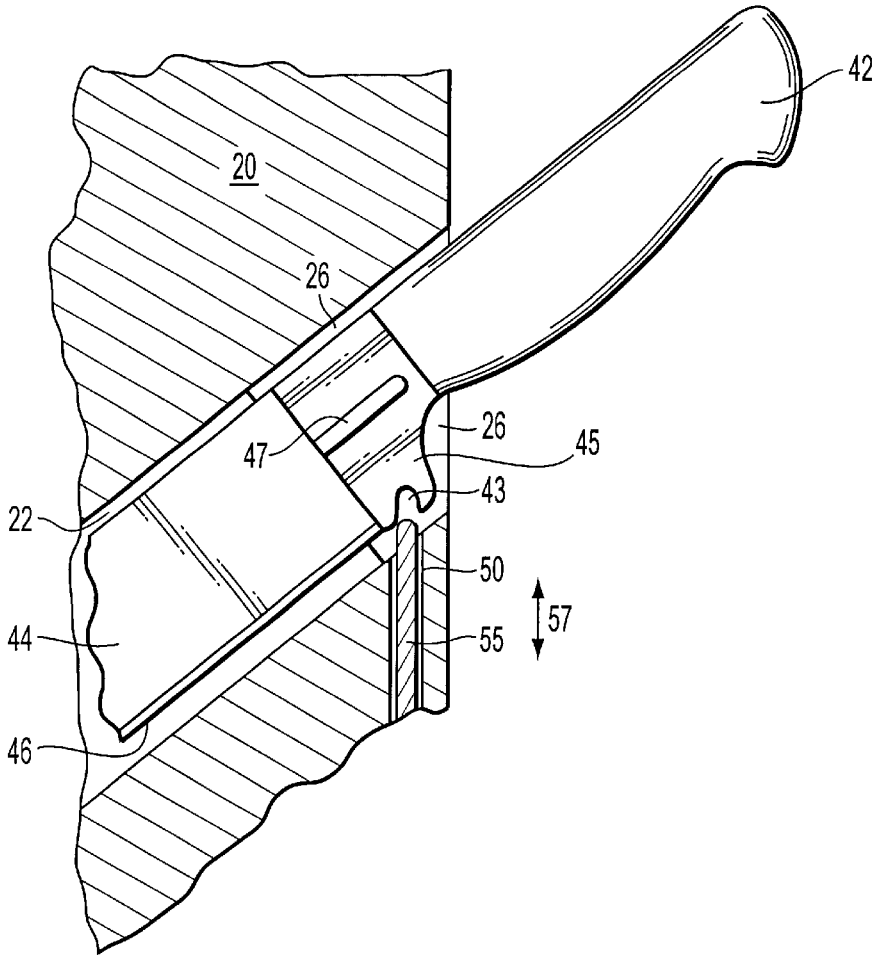
FIG. 6 is a cross-sectional side view of a knife holder according to another embodiment of the invention, generally similar to the arrangement shown in FIGS. 3–5, except that the knife block further includes a locking mechanism to lock knives in place within the knife block.

It is also possible to provide a locking mechanism by which the knives are locked within the knife holder. Such an arrangement is shown in FIG. 6. The basic structure is similar to what is described in the inventor's above-noted related U.S. Pat. No. 6,375,016B1, except that the locking mechanism engages the knife handle which is inserted into the knife block), rather than engaging the blade. In addition, the locking mechanism engages with a lower portion of the knife, rather than the upper portion of the knife as described in the related application. As shown in FIG. 6, the block 20 includes a vertically extending passage 50 in which a locking member 55 moves. As shown by arrow 57, the locking member 55 moves up and down. The locking member can be spring biased in the upward direction so that it will be inserted into a notch 43 provided in the lower portion of the front part 45 of the handle in order to lock the knife 40 within the knife holder block 20. It is advantageous to provide the notch in the knife handle, rather than in the knife blade because it enables standard knife blades to be used. It is, of course, possible to have the locking member engage the upper portion of the handle, or to have the locking member engage the blade (from above or below). The remainder of the knife structure and the knife-receiving slot structure can be the same as described above with respect to FIGS. 1–5, 7A and 7B.

The invention is not limited to the illustrated embodiments. The engaging structure, which is the structure that supports the knife within the knife block, can be elements other than a protrusion and a groove. In addition, and as noted earlier, when elements such as protrusions/grooves are used, such elements can be provided on either the knife handle or the knife blade (as well as within the knife-holding slot). The engaging structures can be the enlarged opening of the knife-holding slot and the corresponding front portion of the knife handle (i.e., it is not necessary to provide additional elements such as protrusions/grooves). The enlarged opening (if provided) and the corresponding front portion of the knife handle need not be tapered. However, the tapered structure is preferable because it is easier to insert such knives into the knife holder, and also is more aesthetically pleasing.

It is not necessary for all of the knife-receiving slots in the knife block to include the engaging structure of the invention. For example, it may be desirable to provide the engaging structure only on knives that are not serrated. In addition, if the knife block includes slots that are not intended to receive knives (for example, it is common to provide slots that hold scissors or a sharpening tool), it is not necessary to include the engaging structure for such slots.

While the present invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A knife set comprising:

a knife block having a plurality of knife-receiving slots, each of the slots extending into the knife block in a non-vertical direction so as to be capable of containing a knife-blade in the slot, each of the slots having an opening through which a knife can be inserted into the slot;

a plurality of knives, corresponding in number to the plurality of knife-receiving slots, each of the knives having a handle and a blade, each of the blades having a sharpened edge;

at least one of the knives, and a corresponding at least one of the knife-receiving slots, having engaging structures that support the at least one knife in the corresponding at least one slot so that the sharpened edge is suspended within the slot out of contact with any portion of the knife block, the engaging structures being arranged relative to each other and the slot so that while the engaging structures are engaged with each other, the at least one knife is held to the corresponding at least one slot so that the sharpened edge of the blade of the at least one knife is held at a position spaced away from any portion of the knife block, and the sharpened edge of the blade cannot be contacted with any portion of the knife block, wherein the engaging structures include the opening of the at least one slot and a front portion of the handle of the at least one knife located adjacent to the blade, the front portion of the handle being inserted into and held by the opening of the at least one slot.

2. The knife set of claim 1, wherein the opening of the at least one slot is enlarged compared with a portion of the at least one slot that encloses the blade of the at least one knife.

3. The knife set of claim 2, wherein the opening of the at least one slot and the front portion of the handle of the at least one knife are tapered so as to mate with each other.

4. The knife set of claim 3, wherein the opening of the at least one slot includes a groove that receives a protrusion on the front portion of the at least one knife.

5. The knife set of claim 3, wherein the front portion of the at least one knife includes a groove that receives a protrusion in the opening of the at least one slot.

6. The knife set of claim 1, wherein the opening of the at least one slot includes a groove that receives a protrusion on the front portion of the at least one knife.

7. The knife set of claim 1, wherein the front portion of the at least one knife includes a groove that receives a protrusion in the opening of the at least one slot.

8. The knife set of claim 1, wherein more than one of the plurality of knives, and a corresponding more than one of the knife-receiving slots, include the engaging structures.

9. The knife set of claim 1, wherein all of the knives and all of the corresponding knife-receiving slots include the engaging structures.

10. The knife set of claim 1, wherein the knife-receiving slots hold the knives so that the knife blades are oriented vertically with the sharpened edges facing downward.

11. A knife set comprising:

a knife block having a plurality of knife-receiving slots, each of the slots extending into the knife block in a non-vertical direction so as to be capable of containing a knife-blade in the slot, each of the slots having an opening through which a knife can be inserted into the slot;

a plurality of knives, corresponding in number to the plurality of knife-receiving slots, each of the knives having a handle and a blade, each of the blades having a sharpened edge;

at least one of the knives, arid a corresponding at least one of the knife-receiving slots, having engaging structures that support the at least one knife in the corresponding at least one slot so that the sharpened edge is suspended within the slot out of contact with any portion of the knife block, the engaging structures being arranged relative to each other, the at least one knife is held to the corresponding at least one slot so that the sharpened edge of the blade of the at least one knife is held at a position spaced away from any portion of the knife block, and the sharpened edge of the blade cannot be contacted with any portion of the knife block, wherein the engaging structures include a groove in the opening of the at least one slot that receives a protrusion provided on the corresponding at least one knife.

12. The knife set of claim 11, wherein the protrusion is provided on the handle of the at least one knife.

13. The knife set of claim 12, wherein a front portion of the handle of the at least one knife is insertable into the opening of the at least one slot, the groove is provided in the opening of the at least one slot, and the protrusion is provided on the front portion of the handle.

14. A knife set comprising:

a knife block having a plurality of knife-receiving slots, each of the slots extending into the knife block in a non-vertical direction so as to be capable of containing a knife-blade in the slot, each of the slots having an opening through which a knife can be inserted into the slot;

a plurality of knives, corresponding in number to the plurality of knife-receiving slots, each of the knives having a handle and a blade, each of the blades having a sharpened edge;

the opening of at least one of the knife-receiving slots being enlarged, and the handle of a corresponding at least one of the knives having a front portion located adjacent to the blade, the front portion is insertable into and held by the enlarged opening of the at least one knife-receiving slot so that the at least one knife is supported in the knife block by the handle, the enlarged opening and the front portion of the handle being arranged relative to each other and the slot so that while the enlarged opening and the front portion of the handle are engaged with each other, the at least one knife is held to the at least one slot so that the sharpened edge of the blade of the at least one knife is held at a position spaced away from any portion of the knife block, and the sharpened edge of the blade cannot be contacted with any portion of the knife block.

15. The knife set of claim 14, wherein the enlarged opening of the at least one knife-receiving slot and the front portion of the handle of the at least one knife are tapered so as to mate with each other.

16. The knife set of claim 14, further comprising a groove and a protrusion, the groove provided in a first one of the enlarged opening and the front portion of the at least one knife, and the protrusion provided on a second one of the enlarged opening and the front portion of the at least one knife.

17. The knife set of claim 14, wherein the opening of all of the knife-receiving slots are enlarged, and the handles of all of the corresponding knives having front portions that are insertable into the enlarged openings.

* * * * *